US007382179B2

(12) United States Patent
Geller

(10) Patent No.: US 7,382,179 B2
(45) Date of Patent: Jun. 3, 2008

(54) VOLTAGE REFERENCE WITH ENHANCED STABILITY

(76) Inventor: Joseph M. Geller, 105 Hardcastle Ave., Whitesboro, NY (US) 13492

( * ) Notice: Subject to any disclaimer, the term of this patent is extended or adjusted under 35 U.S.C. 154(b) by 38 days.

(21) Appl. No.: 11/317,319

(22) Filed: Dec. 23, 2005

(65) Prior Publication Data

US 2006/0145750 A1 Jul. 6, 2006

Related U.S. Application Data

(60) Provisional application No. 60/641,099, filed on Jan. 3, 2005.

(51) Int. Cl.
*G05F 1/10* (2006.01)

(52) U.S. Cl. ..... 327/538; 327/513; 323/313

(58) Field of Classification Search ..... 327/513, 327/538–541; 323/313, 316
See application file for complete search history.

(56) References Cited

U.S. PATENT DOCUMENTS 5,892,388 A * 4/1999 Chiu ..... 327/543
5,936,392 A * 8/1999 Taylor ..... 323/315
6,052,020 A * 4/2000 Doyle ..... 327/539
6,466,081 B1 * 10/2002 Eker ..... 327/541
6,542,004 B1 * 4/2003 Dunne ..... 326/87
6,590,372 B1 * 7/2003 Wiles, Jr. ..... 323/316
6,803,803 B1 * 10/2004 Starr et al. ..... 327/378
7,057,382 B2 * 6/2006 Sigurdardottir ..... 323/313
2003/0090314 A1 * 5/2003 Kronmueller et al. ..... 327/543
2004/0207379 A1 * 10/2004 Camara et al. ..... 323/313

OTHER PUBLICATIONS

National Semiconductor Corporation, LM199/LM299/LM399 Precison Reference Data Sheet, DS005717, Apr. 2005, <www.national.com>.
Analog Devices , Inc., High Precision 10V Reference AD587 Data Sheet, Rev.G, C 00530-0-4/05 (G), Apr. 2005, <www.analog.com>.
Linear Technology Corporation, LTZ1000/LTZ1000A, Ultra Precision Reference Data Sheet, LTO206REVB, 1987, Feb. 2006, <www.linear.com>.
Joseph M. Geller, Geller Labs Introduces A New High Stability Low Noise Voltage Reference; LNVR-Bx-01HS, Mar. 2005, <www.gellerlabs.com>.

* cited by examiner

*Primary Examiner*—N. Drew Richards
*Assistant Examiner*—William Hernandez

(57) ABSTRACT

A composite voltage reference with improved temperature stability includes a monolithic voltage reference integrated circuit ("IC"). The voltage reference IC has an internal voltage reference, an internal OpAmp circuit including scaling resistors, a monolithic voltage reference IC temperature coefficient, and a user accessible input to vary a monolithic voltage reference IC output voltage. A second voltage reference has a second voltage reference temperature coefficient lower than the monolithic voltage reference IC temperature coefficient. The second voltage reference is electrically coupled to the user accessible input wherein the temperature coefficient of the composite circuit of the monolithic voltage reference IC and the second voltage reference is improved over the monolithic voltage reference IC temperature coefficient.

14 Claims, 1 Drawing Sheet

VOLTAGE REFERENCE WITH ENHANCED STABILITY

CROSS REFERENCE

The present application is a non-provisional application from U.S. provisional patent application Ser. No. 60/641,099, "Voltage reference with enhanced stability", filed on Jan. 3, 2005. The priority of the 60/641,099 application is claimed and the 60/641,099 application is incorporated herein by reference in its entirety.

FIELD OF THE INVENTION

This invention relates generally to voltage references and in particular to circuit topologies for enhancing the stability of inexpensive monolithic voltage references.

BACKGROUND OF THE INVENTION

Voltage references are used to transfer the standard unit of voltage from a National Institute of Standards ("NIST") traceable standard to a laboratory and ultimately to an instrument or measurement circuit. Decades ago, standard chemical cells served this purpose. But, standard cells typically comprise hazardous elements such as Cadmium and Mercury in glass tubes. Even when further encased in outer cases, they are still subject to slight changes in voltage with mechanical upset and temperature.

Major laboratories needing the best primary voltage references can now use a voltage standard based on Josephson junctions. When cooled to superconducting temperatures and irradiated by a precise microwave frequency, hundreds of Josephson junctions wired in series provide a standard voltage based on physical constants. Such standards however are very expensive, costing in excess of ten thousand dollars. And they need a reservoir of liquid Helium to cool the Josephson junctions. Such standards are not practical for smaller companies or laboratories. And, they are neither small enough nor cost effective for use in precision instrumentation circuits.

Temperature compensated zener diodes, including the 1N821 family, and in particular 1N829A compensated zener diodes are stable enough to fulfill many precision voltage reference applications. Since the 1N829A diode is very sensitive to zener bias current, the reference diode bias current must be provided by a precision current source or a resistor coupled to the reference output in a "bootstrap" topology. By using precision non-inverting OpAmp configurations, a variety of desired output voltages, such as 10.000 Volts can be derived from the diodes fixed voltage near 6.2 V.

Another zener based voltage reference uses a small device comprising a zener diode type semiconductor element, an internal heater, and a temperature control circuit. The internal heater of the device package maintains the internal semiconductor elements at nearly constant temperature. Such devices can further include second and third order correction devices such as junctions and transistors on the same die. This type of device is typically packaged in a standard semiconductor package. The device package can further comprise optional outer layers of insulation, such as a plastic outer casing, to further thermally isolate the tiny oven controlled environment from the ambient atmosphere. Classic devices of this type include the National Semiconductor LM199/LM399 families. More sophisticated versions, as Linear Technology's LTZ1000 families are capable of the highest levels of precision with short term changes in voltage with temperature of better than 0.1 part per million ("ppm")/degree C. These devices however can only generate a single voltage typically falling between 6.8 and 7.1 Volts. And, they do not include an internal amplifier for driving reference loads.

Monolithic zener based voltage reference chips are the most commonly used voltage reference chips. These chips draw their precision from zener type devices and bandgap references. Monolithic voltage reference chips typically also include an internal non-inverting OpAmp circuit to generate a predetermined output voltage. Common output voltages are 1.024, 2.048, 4.096, 5.000, and 10.000 Volts. Any voltage can be generated by use of the appropriate internal resistors. One or more of these resistances are usually laser trimmed to bring absolute output voltages to within 1 to 0.1% of the rated voltage. Stability with temperature for monolithic reference integrated circuit ("IC") chips generally ranges from 5 to 50 ppm/degree C.

What is needed is an inexpensive circuit topology that can achieve the temperature stability of ovenized zener devices while offering the choice of output voltages and output drive capability available from monolithic references.

SUMMARY OF THE INVENTION

In one aspect, the invention relates to a composite voltage reference with improved temperature stability includes a monolithic voltage reference integrated circuit ("IC"). The voltage reference IC has an internal voltage reference, an internal OpAmp circuit including scaling resistors, a monolithic voltage reference IC temperature coefficient, and a user accessible input to vary a monolithic voltage reference IC output voltage. The composite voltage reference with improved temperature stability also includes a second voltage reference having a second voltage reference temperature coefficient lower than the monolithic voltage reference IC temperature coefficient. The second voltage reference is electrically coupled to the user accessible input wherein the temperature coefficient of the composite circuit of the monolithic voltage reference IC and the second voltage reference is improved over the monolithic voltage reference IC temperature coefficient.

In one embodiment, the second voltage reference is electrically coupled to the user accessible input of the monolithic voltage reference IC via a resistor.

In another embodiment, the resistor is sized lower than a monolithic voltage reference IC internal resistor coupling the internal voltage reference to the internal OpAmp circuit such that the current from the second voltage reference is greater than the current from the monolithic voltage reference IC internal resistor.

In yet another embodiment, the user accessible input is a noise input terminal that is made user accessible for coupling to a noise reducing capacitor.

In yet another embodiment, the monolithic voltage reference IC output voltage is 10 V±0.5 V, the internal voltage reference is 7 V±0.5 V and the second voltage reference is 7 V±0.5 V.

In yet another embodiment, the voltage reference IC is an AD58* family reference chip.

In yet another embodiment, the second voltage reference is an ovenized voltage reference.

In yet another embodiment, the second voltage reference is an LM199/399* family or LTZ1000* family ovenized voltage reference.

In yet another embodiment, the second voltage reference is biased in a bootstrap configuration by a resistor electrically disposed between the monolithic voltage reference IC output voltage and the second voltage reference.

In another aspect of the invention, the invention features a method to improve the temperature stability of a monolithic voltage reference IC comprising the steps of: a. providing a monolithic voltage reference IC having a user accessible input connection that varies the monolithic voltage reference IC output voltage and an internal voltage reference; b. providing a second voltage reference having a lower temperature coefficient than the monolithic voltage reference IC; and c. dominating the internal voltage reference with the second voltage reference by electrically coupling the second voltage reference to the user accessible input causing an improvement in the temperature stability of the monolithic voltage reference IC output voltage.

In one embodiment, the step of providing a second voltage reference comprises providing a second ovenized voltage reference having a lower temperature coefficient than the monolithic voltage reference IC.

In another embodiment, the step of providing a second ovenized voltage reference comprises providing a second LM199/399* family or LTZ1000* family ovenized voltage reference having a lower temperature coefficient than the monolithic voltage reference IC.

In yet another embodiment, the step of providing a monolithic voltage reference IC comprises providing a monolithic voltage reference IC from the AD58* voltage reference family having a user accessible input connection that varies the monolithic voltage reference IC output voltage and an internal voltage reference.

In yet another embodiment, the step of dominating the internal voltage reference comprises dominating the internal voltage reference with the second voltage reference by electrically coupling the second voltage reference to the user accessible input via a resistor causing an improvement in the temperature stability of the monolithic voltage reference IC output voltage.

In another aspect the invention features a voltage reference with improved temperature stability including a monolithic voltage reference integrated circuit ("IC") means for creating a monolithic voltage reference IC output voltage. The voltage reference IC has an internal voltage reference, an internal OpAmp circuit including scaling resistors, a monolithic voltage reference IC temperature coefficient, and a user accessible input to vary a monolithic voltage reference IC output voltage. The voltage reference with improved temperature stability also includes a power supply means to power the monolithic voltage reference integrated circuit ("IC") means. The voltage reference with improved temperature stability also includes a second voltage reference means for creating a stable second voltage having a second voltage reference temperature coefficient lower than the a monolithic voltage reference IC temperature coefficient. The second voltage reference means is electrically coupled to the user accessible input wherein the temperature coefficient of the coupled circuit of the monolithic voltage reference IC means and the second voltage reference means is improved over the monolithic voltage reference IC means temperature coefficient.

In one embodiment, the second voltage reference means comprises an ovenized voltage reference.

In another embodiment, the monolithic voltage reference IC means output voltage is 10 V±0.5 V, the internal voltage reference is 7 V±0.5 V and the second voltage reference means is 7 V±0.5 V.

BRIEF DESCRIPTION OF THE DRAWINGS

For a further understanding of these and objects of the invention, reference will be made to the following detailed description of the invention which is to be read in connection with the accompanying drawing, where.

Figure 1:
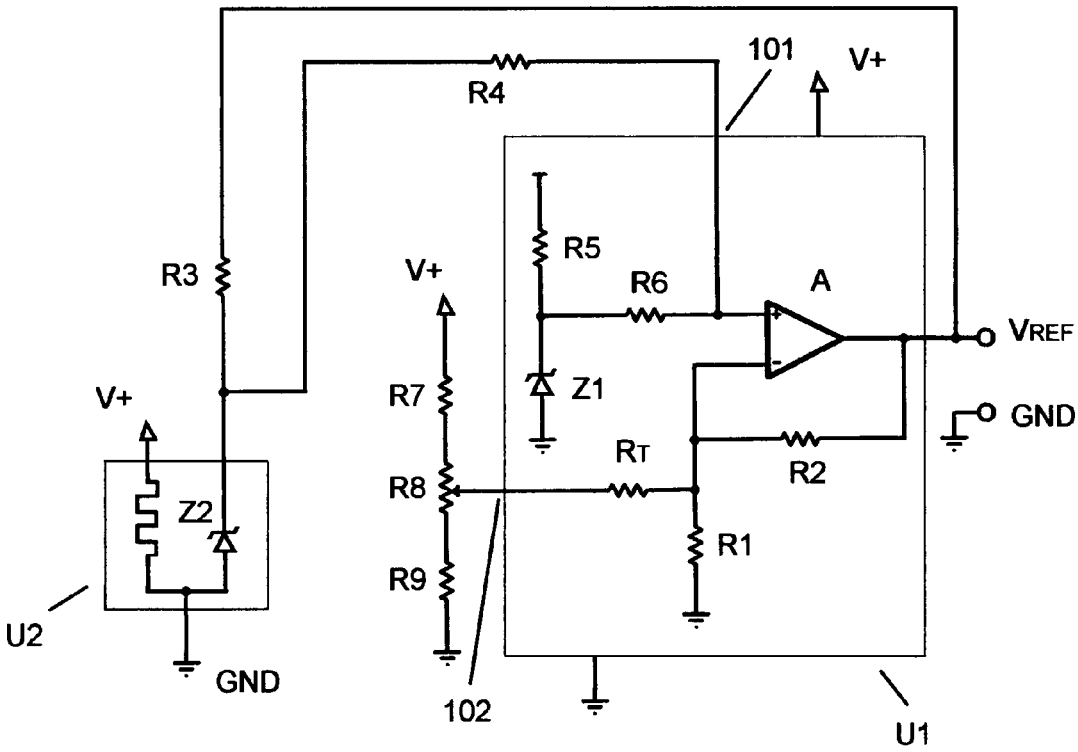
FIG. 1 shows an exemplary embodiment of the inventive circuit topology.

It is to be understood that the drawings are for the purpose of illustrating the concepts of the invention and are not necessarily drawn to scale.

DETAILED DESCRIPTION OF THE INVENTION

FIG. 1 shows a first embodiment of the inventive circuit topology. A monolithic device, such as the Analog Devices AD58* family device is further temperature stabilized by ovenized device U2 providing a substantial percentage of the voltage reference for U1. Both devices can be advantageously powered by one power source represented as V+.

Ovenized devices are typically available only in fixed non-standard voltages, such as between 6.9 and 7.1 Volts. And, ovenized devices such as the LM399 or LTZ1000 families do not generally incorporate output amplifiers to drive a load coupled to the reference. Monolithic devices, on the other hand, offer one or more internal amplifiers and resistors for setting standard output voltages (other than those available in ovenized devices) and the same amplifier for driving loads, but their temperature stability is far inferior to ovenized devises. According to the inventive technique, an inexpensive monolithic reference with a temperature coefficient of 5 to 50 ppm/degree C. can be made to approach the exceptional temperature stability (better than 1 ppm/degree C.) of a typical fixed ovenized device. Thus, it can be seen that the inventive circuit topology advantageously exhibits positive attributes of both technologies in one cost effective combined circuit.

The AD587LN monolithic reference for example, is a 10 V monolithic voltage reference with a temperature coefficient of 5 ppm/degree C. A monolithic voltage reference of this exemplary type is shown as voltage reference chip U1. The internal details of U1 are only shown in basic functional form to illustrate the principle of the circuit topology of this first embodiment. Internal diode Z1 is typically on the order of 7 V. R5 biases Z1 and R6 can serve in part to isolate and match inputs for internal OpAmp A, as in Amplifier bias compensation. The primary function of R6 however, is to set the RC roll off pole in conjunction with an external capacitor connected to the noise reduction pin of the monolithic reference chip. The reference voltage of Z1 is applied to the non-inverting input of the non-inverting amplifier stage built around A. Resistors R2 and R1 {G=(1+(R2/R1))} provide the needed gain to achieve the desired Vref reference output voltage, such as 10.000 00 V. Ovenized device U2 can be for example, an LM399 family device. Internal zener Z2 of U2 generates a temperature stable voltage of about 7 V. In this embodiment of the invention, the ultra-stable voltage of U2 is applied to U1 via a user accessible U1 pin 101 (FIG. 1) that accesses the non-inverting input of A. By sizing the coupling resistor R4 lower than internal coupling resistor R6, The U2 voltage can be made to dominate over the voltage reference provided by internal zener Z1. Thus, it can now be seen that an inexpensive ultra-stable reference has been created by this circuit topology with a temperature coefficient far lower than was possible with U1 alone. Typically monolithic chip U1 will have had one or more of its resistors laser trimmed to create the standard output voltage based on internal zener Z1. Most monolithic reference chips advantageously provide an additional trim input 102 (FIG. 1) as shown in FIG. 1 at RT. By adding resistors R7 and R9, with trimmer R8, the output voltage can be calibrated back to the standard output value. Since calibration is done with a completed circuit, it can usually be done to an absolute value that is far closer to the rated value than when U1 was laser trimmed. Other trim topologies can be used.

EXAMPLE

An LM399H was used as U2 in conjunction with an AD587LN monolithic voltage reference chip with the values of other components advantageously sized as follows:

R3: 3.32 kilo ohms
R4: 820 ohms
R7: 4.99 kilo ohms
R8: 1.00 kilo ohms
R9: 3.32 kilo ohms
(bypass and filter capacitors are omitted for simplicity)

Approximately 90% of the reference signal delivered to amplifier A came from U2, while 10% came from the original U1 internal reference Z1. The temperature stability of the U1/U2 voltage reference was observed to be better than 1 ppm/degree C. This is better than the 5 ppm/degree stability of U1 alone by a factor of more than 5, a very significant improvement for an inexpensive voltage reference. The output voltage was trimmed to 10.000 00 Volts plus or minus 1 ppm absolute.

It is noted that U2 can also drift in time, particularly during the first 1,000 hours of operation by more than 10 ppm, but such references become more stable with time and even short term calibration to better than 10 ppm can be extremely important for use as a transfer standard. For example, a board including the circuit of the Example was calibrated to a Fluke 732b 10 Volt (9.999 998 5 V) primary laboratory standard with an NIST traceable calibration. After a suitable warm up time, typically tens of minutes, the voltage reference output of the board can be used to verify the voltage measurement of anther instrument in the same or advantageously, another location. The transfer accuracy of the board is somewhat lower than the absolute accuracy of the 732b at +/−10 uV (1 ppm on a 10 Volt scale), but still more accurate than needed for many typical transfer applications. The circuit of the Example can alternatively be employed as part of a larger measurement system, such as a voltage reference for one or more analog to digital converters ("ADC") and or one or more digital to analog converters ("DAC").

It was unexpected and surprising that a connection could be made to an inexpensive monolithic reference chip to replace its internal reference by an external reference current wherein the external reference dominates the combined reference leading to enhanced stability. In the case of the AD587, the needed input for access to the non-inverting input of A is one that is taught by the manufacturer's data sheet to be used as a noise reduction pin for connection to an external capacitor. It was thought to not be suitable for control signal injection. In fact the resistive isolation, that makes signal injection possible, is sized to make an RC filter and not to permit external access for an alternate dominating reference. It is further contemplated that both Analog Devices™ ("AD") and other reference families might have diagnostic pins, not intended for customer use that might also be suitable for this type of stability enhancement. It is further noted that whilst the examples have referred to the AD58* family of monolithic references and LM199/399 ovenized devices, similar devices as offered by Linear Technology™, National Semiconductor™, Maxim™, and other manufacturers of semiconductor references can be used. Moreover, U2 can be any type of suitable reference with a better temperature coefficient than Z1 of U1.

The combination of a monolithic reference and a second more temperature stable reference as described herein can be referred to as a "composite" voltage reference circuit.

While the present invention has been particularly shown and described with reference to the preferred mode as illustrated in the drawing, it will be understood by one skilled in the art that various changes in detail may be effected therein without departing from the spirit and scope of the invention as defined by the claims.

We Claim:

1. A composite voltage reference with improved temperature stability comprising:

a monolithic voltage reference integrated circuit ("IC"), the voltage reference IC having an internal voltage reference, an internal OpAmp circuit including scaling resistors, a monolithic voltage reference IC temperature coefficient, and a user accessible input to vary a monolithic voltage reference IC output voltage; and a second voltage reference having a second voltage reference temperature coefficient lower than the monolithic voltage reference IC temperature coefficient, the second voltage reference electrically coupled to the user accessible input wherein the temperature coefficient of the composite circuit of the monolithic voltage reference IC and the second voltage reference is improved over the monolithic voltage reference IC temperature coefficient and wherein the second voltage reference is electrically coupled to the user accessible input of the monolithic voltage reference IC via a resistor.

2. The composite voltage reference of claim 1 wherein the resistor is sized lower than a monolithic voltage reference IC internal resistor coupling the internal voltage reference to the internal OpAmp circuit such that the current from the second voltage reference is greater than the current from the monolithic voltage reference IC internal resistor.

3. The composite voltage reference of claim 1 wherein the user accessible input is a noise input terminal that is made user accessible for coupling to a noise reducing capacitor.

4. The composite voltage reference of claim 1 wherein the monolithic voltage reference IC output voltage is 10 V±0.5 V, the internal voltage reference is 7 V±0.5 V and the second voltage reference is 7 V±0.5 V.

5. The composite voltage reference of claim 4 wherein the voltage reference IC is an AD58* family reference chip.

6. The composite voltage reference of claim 1 wherein the second voltage reference is an ovenized voltage reference.

7. The composite voltage reference of claim 6 wherein the second voltage reference is an LM199/399* family or LTZ1000* family ovenized voltage reference.

8. The composite voltage reference of claim 1 wherein the second voltage reference is biased in a bootstrap configuration by a resistor electrically disposed between the monolithic voltage reference IC output voltage and the second voltage reference.

9. A method to improve the temperature stability of a monolithic voltage reference IC comprising the steps of:

a. providing a monolithic voltage reference IC having a user accessible input connection that varies a monolithic voltage reference IC output voltage and an internal voltage reference;

b. providing an ovenized voltage reference having a lower temperature coefficient than the monolithic voltage reference IC; and c. dominating the internal voltage reference with the ovenized voltage reference by electrically coupling the ovenized voltage reference to the user accessible input causing an improvement in the temperature stability of the monolithic voltage reference IC output voltage.

10. The method of claim 9 wherein the step of providing an ovenized voltage reference comprises providing a LM199/399* family or LTZ1000* family ovenized voltage reference having a lower temperature coefficient than the monolithic voltage reference IC.

11. The method of claim 10 wherein the step of providing a monolithic voltage reference IC comprises providing a monolithic voltage reference IC from the ADS58* voltage reference family having a user accessible input connection that varies the monolithic voltage reference IC output voltage and an internal voltage reference.

12. The method of claim 9 wherein the step of dominating the internal voltage reference comprises dominating the internal voltage reference with the ovenized voltage reference by electrically coupling the ovenized voltage reference to the user accessible input via a resistor causing an improvement in the temperature stability of the monolithic voltage reference IC output voltage.

13. A voltage reference with improved temperature stability comprising:

a monolithic voltage reference integrated circuit ("IC") means for creating a monolithic voltage reference IC output voltage, the voltage reference IC having an internal voltage reference, an internal OpAmp circuit including scaling resistors, a monolithic voltage reference IC temperature coefficient and a user accessible input to vary a monolithic voltage reference IC output voltage;

a power supply means to power the monolithic voltage reference integrated circuit ("IC") means; and an ovenized voltage reference means for creating a stable ovenized voltage having an ovenized voltage reference temperature coefficient lower than the monolithic voltage reference IC temperature coefficient, the ovenized voltage reference means electrically coupled to the user accessible input wherein the temperature coefficient of the coupled circuit of the monolithic voltage reference IC means and the ovenized voltage reference means is improved over the monolithic voltage reference IC means temperature coefficient.

14. The voltage reference of claim 13 wherein the monolithic voltage reference IC means output voltage is 10 V±0.5 V, the internal voltage reference is 7 V±0.5 V and the ovenized voltage reference means is 7 V±0.5 V.

* * * * *